US005121130A

United States Patent [19]

Hempel et al.

[11] Patent Number: 5,121,130

[45] Date of Patent: Jun. 9, 1992

[54] THERMAL INK JET PRINTING APPARATUS

[75] Inventors: George O. Hempel, Pittsford; Herman A. Hermanson, Penfield; Roger G. Markham, Webster, all of N.Y.

[73] Assignee: Xerox Corporation, Stamford, Conn.

[21] Appl. No.: 608,863

[22] Filed: Nov. 5, 1990

[51] Int. Cl.[5] ..... B41J 2/05

[52] U.S. Cl. ..... 346/1.1; 346/140 R

[58] Field of Search ..... 346/140, 75, 1.1

[56] References Cited

U.S. PATENT DOCUMENTS

| | | | |
|---|---|---|---|
| 4,454,518 | 6/1984 | Bangs | 346/140 R |
| 4,463,359 | 7/1984 | Ayata et al. | 346/1.1 |
| 4,499,478 | 2/1985 | Matsufuji | 346/140 R |
| 4,543,591 | 9/1985 | Terasawa | 346/140 R |
| 4,577,203 | 3/1986 | Kawamura | 346/140 R |
| 4,600,931 | 7/1986 | Terasawa | 346/140 R |
| 4,658,272 | 4/1987 | Toganoh | 346/140 |
| 4,692,777 | 9/1987 | Hasumi | 346/140 |
| 4,727,378 | 2/1988 | Le et al. | 346/1.1 |
| 4,734,719 | 3/1988 | Suzuki | 346/140 R |
| 4,739,340 | 4/1988 | Terasawa | 346/1.1 |
| 4,853,717 | 8/1989 | Harmon et al. | 346/140 R |
| 4,896,172 | 1/1990 | Nozawa | 346/140 |
| 4,929,963 | 5/1990 | Balazar | 346/1.1 |
| 4,980,702 | 12/1990 | Kneezez | 346/140 |
| 5,017,941 | 5/1991 | Drake | 346/140 X |

FOREIGN PATENT DOCUMENTS 0210848 7/1986 European Pat. Off. .

*Primary Examiner*—Joseph W. Hartary
*Attorney, Agent, or Firm*—Robert A. Chittum

[57] ABSTRACT

In a printhead assembly for a thermal ink jet printer there are a plurality of printheads mounted on a common heat sink, together with a heater and temperature controller for maintaining temperature of the printheads at an appropriate operating level. To prevent overheating of a printhead during periods of heavy use, the ink supply paths carrying ink to the printheads pass through, and receive heat from, the heat sink. The ink in each supply path then passes to the respective printhead via a tank, the position of which relative to the printhead establishes the ink pressure at the printhead discharge orifices. The tank is vented so that any air separating out from the ink can be removed. Capping means is provided to cap the ink discharge orifices when the printhead is idle and to prime/clean the printhead when required.

13 Claims, 2 Drawing Sheets

THERMAL INK JET PRINTING APPARATUS

BACKGROUND OF THE INVENTION

The present invention relates to thermal ink jet printing apparatus and is concerned, more particularly, with the ink supply system of a thermal ink jet printhead.

A thermal ink jet printer has at least one printhead in which thermal energy pulses are used to produce vapour bubbles in ink-filled channels and so cause droplets of ink to be expelled from the channel orifices towards a recording medium. The thermal energy pulses are usually produced by resistors, each located in a respective one of the channels, which are individually addressable by current pulses to heat and vaporize ink in the channels. As a vapour bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Some arrangement is usually provided to clean the channel orifices periodically while the printhead is in use and to close-off the orifices when the printhead is idle to prevent the ink in the printhead from drying out.

One form of thermal ink jet printer is described in EP-A-0 210 848. That printer is of the carriage type and has a plurality of printheads, each with its own ink supply cartridge, mounted on a reciprocating carriage. The channel orifices in each printhead are aligned perpendicular to the line of movement of the carriage and a swath of information is printed on the stationary recording medium as the carriage is moved in one direction. The recording medium is then stepped, perpendicular to the line of carriage movement, by a distance equal to the width of the printed swath and the carriage is then moved in the reverse direction to print another swath of information. As an alternative to providing each printhead with its own ink cartridge, the printheads can be supplied with ink from one or more supply tanks which need not be mounted on the carriage.

In another form of thermal ink jet printer, several printheads are accurately juxtapositioned to form a pagewidth array which remains stationary while the recording medium is moved at a constant speed in a direction perpendicular to the length of the array. Printers of that type are described in U.S. Pat. No. 4,463,359 to Ayata et al (see FIGS. 17 and 20). In those particular printers, the printheads are mounted on a common metal plate which functions as a heat sink, for efficient dissipation of heat generated when the printer is in operation.

U.S. Pat. No. 4,454,518 refers to the importance of temperature control in an ink jet printer and, in particular, the control of the ink temperature in a printer of the type that utilizes a piezoelectric transducer to cause the discharge of ink droplets from a print head. U.S. Pat. No. 4,929,963 describes the cooling of the printhead of a thermal ink jet printer by causing ink to flow through the printhead in a volume far greater than the volume required for printing purposes.

It has also been recognized that there is a need for periodic maintenance of the printhead of an ink jet printer by, for example, periodically cleaning the ink discharge orifices when the printer is in use and/or by capping them when the printer is out of use or is idle for extended periods. Maintenance stations for the printheads of various types of ink jet printer are described in, for example, U.S. Pat. Nos. 4,853,17; 4,739,340; 4,734,719; 4,600,931; 4,577,203 and 4,543,591 while an alternative arrangement for cleaning an ink jet printhead is described in U.S. Pat. No. 4,727,378.

SUMMARY OF THE INVENTION

It is an object of the present invention to provide an improved printhead assembly for an ink jet printer, of the type comprising a plurality of printheads and a common heat sink in heat exchange relationship with the printheads.

More especially, it is an object of the invention to provide an assembly which enables effective temperature regulation of the printheads to be achieved without destroying the compact nature of the assembly.

It is a further object of the invention to provide such an assembly which enables efficient operation of the printhead and which also enables effective maintenance of the printhead nozzles to be achieved in a comparatively simple manner.

According to the present invention, in a printhead assembly for a thermal ink jet printer, the ink supply paths for supplying ink to the printheads are so positioned that ink passing along the supply paths receives heat from the printhead assembly. Advantageously, the ink supply paths pass through the common heat sink which is in heat exchange relationship with the printheads of the printhead assembly.

The present invention also provides a printhead assembly having an ink supply path for carrying ink from a reservoir to a printhead; a tank connected in the said supply path and providing a location at which ink being supplied to the printhead can accumulate whereby the position of the tank relative to the printhead establishes the ink pressure at the ink ejecting orifice(s); vent means venting the tank to atmosphere, and a return path from the said tank to the reservoir. The ink supply path between the reservoir and the tank passes through the common heat sink which is in heat exchange relationship with the printheads of the printhead assembly.

In an embodiment of the invention, pump means is provided in the supply path to deliver ink from the reservoir to the tank. Capping means is also provided for engagement with the printhead to cap the ink ejecting orifice(s), together with a suction path connecting the capping means to the reservoir. Suction means may be provided to apply suction to the capping means and, possibly, also to the tank, for example via the first reservoir.

BRIEF DESCRIPTION OF THE DRAWINGS

By way of example, an embodiment of the invention will be described with reference to the accompanying drawings, in which.

DESCRIPTION OF THE PREFERRED EMBODIMENT

Figure 1:
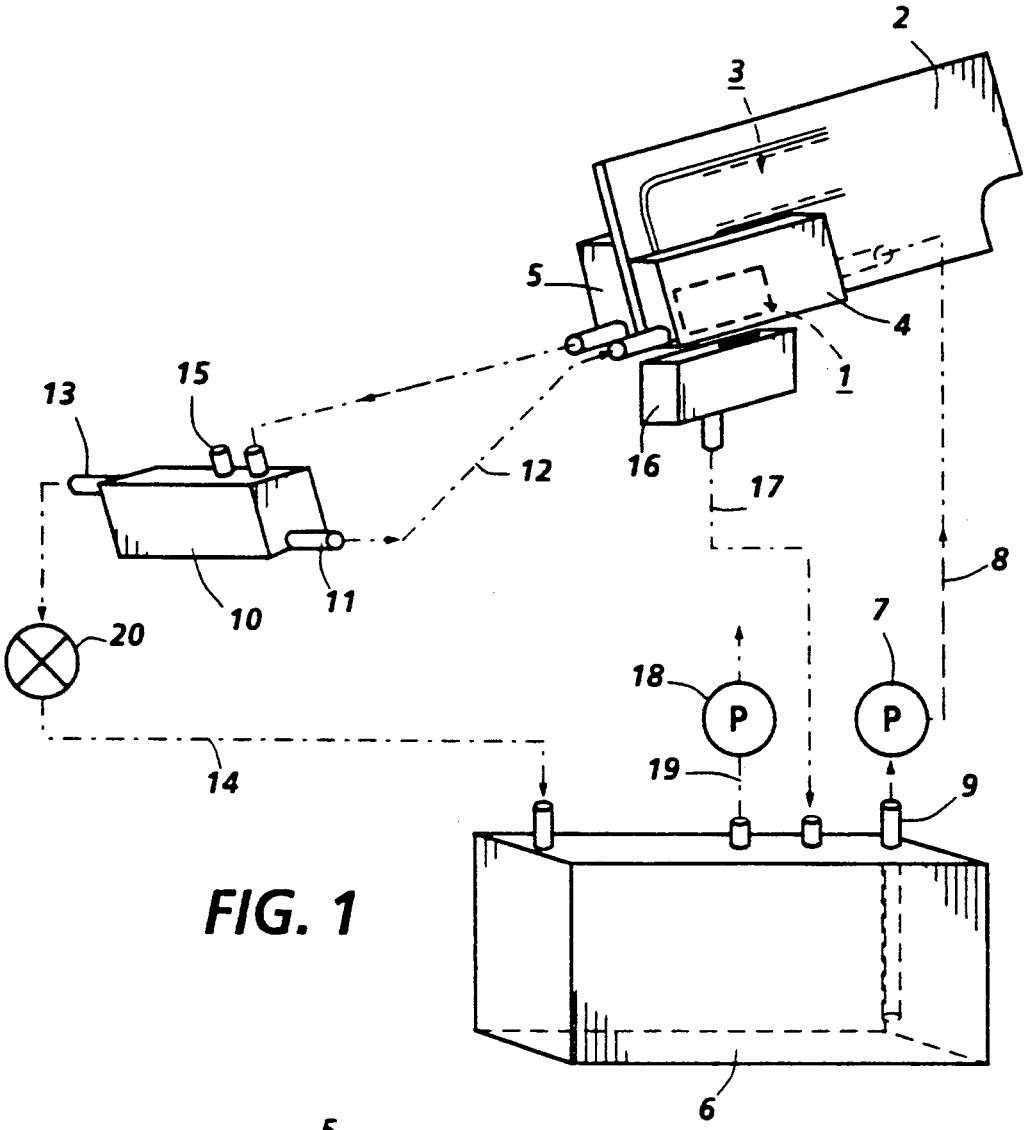
FIG. 1 is a diagram of a printhead assembly for a thermal ink jet printer including the associated ink supply system.

The printhead 1 of the assembly, which is shown in FIG. 1 in dashed line, is permanently mounted on an electrode board 2, (which is thermally conductive). The printhead is better shown in FIG. 2 and contains a plurality of ink channels (not visible) each of which terminates in a discharge orifice 1A and contains a selectively addressable resistor (not shown) which, when energized, causes a drop of ink to be expelled from the orifice towards a recording medium (not shown). An example of the printhead used in this invention is described in detail in U.S. Pat. Nos. 4,774,530 and 4,899,181 and these patents are incorporated herein by reference. The addressing electrodes 3 for the resistors are patterned on the surface of the board 2 (see FIG. 1) and are connected to the resistor terminals 3A on the printhead, some of which are visible in FIG. 2. The electrodes are electrically insulated from the board by an insulative layer (not shown) or the electrodes may be formed on a printhed circuit board (not shown) and bonded to the board adjacent to the printhead so that a direct thermal path is maintained between the board and the directly contacting printhead mounted thereon. An adaptor block 4, through which ink is supplied to the printhead channels via fill holes 4A and a manifold in the printhead, is mounted over the printhead on the side of the printhead housing the fill holes and the other side of the printhead is mounted on one side of the board 2. A heat sink 5 is mounted on the side of the board opposite the one with the printhead. The adaptor block 4 is omitted from FIG. 2.

The ink supply for the printhead 1 is contained in a main supply tank 6. Ink is delivered from the tank by a pump 7 located in a line 8 that extends from the tank outlet 9 and through the heat sink 5 to a secondary supply tank 10. A supply outlet 11 at the bottom of the secondary tank 10 is connected by a line 12 to deliver ink to the printhead adaptor block 4 while a return outlet 13 at the top of the secondary tank is connected by a line 14 to return ink to the main supply tank 6. There is also an air vent 15 at the top of the secondary tank 10.

Ink delivered to the printhead adaptor block 4 passes, via the fill holes 4A (FIG. 2) into the manifold in the printhead. The ink channels in the printhead are filled from that manifold by capillary action in the usual way.

A maintenance station 16 for the printhead is connected to a respective port in the top of the main tank 6 by a line 17. A vacuum pump 18, which is associated with operation of the maintenance station 16 as will be described below, is also connected to a respective port in the top of the main tank, by a line 19.

It will be understood that the system includes fluid filters as appropriate in the ink flow lines, for example in the supply and return lines 8, 14 and in the printhead adaptor block 4.

Operation of the printhead assembly shown in FIG. 1 will now be described and, initially, it will be assumed that the printer of which the assembly forms part is already in operation so that the pump 7 is running and ink is being drawn from the main tank 6. The pump 7 delivers ink to the secondary tank 10 at a rate which, under all conditions, is at least equal to the rate at which ink is withdrawn from the secondary tank for printing (i.e. via the supply outlet 11). Consequently, the ink level within the secondary tank 10 may rise and, if it reaches the return outlet 13, excess ink is returned to the main tank via the line 14.

At the printhead 1, drops of ink are discharged from the channel orifices by the formation of vapour bubbles within the ink channels in known manner. Following each discharge, the channel is re-filled by capillary action from the adaptor block 4 which, as already described, receives ink from the secondary tank 10.

During its passage from the main tank 6 to the secondary tank 10, the ink passes through the heat sink 5 of the printhead, close to the heater resistors in the ink channels, and is heated. Consequently, the ink arrives at the secondary tank 10 with a higher temperature than the ink in the main tank 6 and is, accordingly, more suited to the elevated temperature at which the printhead 1 is operated.

The maintenance station 16, the construction of which is conventional and need not be described in detail, is movable toward and away from the printhead 1 and is used to clean the channel orifices when the printer is in use and also to cap the printhead when the printer is shut down or idle for extended periods. In the latter case, the station 16 (which always contains some ink) is closed against the printhead 1 so that the channel orifices in the printhead open into a sealed, ink-containing chamber in the maintenance station. In that way, the rate of evaporation of liquid ink solvent from the channel orifices is slowed down. When operation of the printer re-commences, the station 16 is moved away from the printhead, the vacuum pump 18 is started up, followed by the ink pump 7, and the printhead heater 21, temperature sensor 23, and temperature controller 22, shown in FIG. 2 and discussed later, are brought into operation. The station 16, which is connected to the vacuum pump 18 through the main tank 6, is then moved back against the printhead to prime and clean the printhead by applying suction to the channel orifices. Ink is drawn through the orifices into the station 16, thereby ensuring that the printhead is filled with ink while removing any air or debris, for example, dirt or dried ink that may have accumulated in the ink channels, and the station 16 is then retracted once again. As the station 16 moves away from the printhead, ink ceases to flow through the channel orifices and, instead, the vacuum pump 18 causes air to be drawn across the printhead to sweep away any remaining ink that might have accumulated on the face of the printhead containing the orifices, especially ink in the vicinity of the orifices which might effect ejected droplet directionality. If desired, the printhead may now be operated to direct ink droplets into the maintenance station 16 to complete the cleaning operation before printing commences. While the printer is active, the printhead can be cleaned if necessary by moving the maintenance station 16 against, and then away from, the printhead to cause the vacuum induced air flow to sweep across the printhead face and remove any ink. When the printer is shut down again, the ink pump 7 is stopped and the printhead heater and temperature controller are shut off. The vacuum pump 18 is then stopped and the maintenance station 16 is closed against the printhead to cap the latter as already described. The connection of the line 17 to the station 16 is positioned to ensure that some ink remains in the station to provide the humid environment that will retard evaporation from the printhead orifices as already described.

It will be appreciated that the maintenance station 16 could be connected to a vacuum pump 18 directly instead of through the tank 6 as shown in the drawing. However, the arrangement shown has the advantage that any ink drawn from the printhead during a cleaning operation flows directly into the tank 6 while ensuring that the return outlet 13 of the secondary tank is connected to a source of suction (via the top of the main tank) to prevent overfilling. As yet another alternative, the ink pump 7 need not be operated when the printhead 1 is being primed. In that case, a valve 20 in the return line 14 from the secondary tank 10 is closed during priming, so that the only ink withdrawn from the secondary tank 10 when the vacuum pump 18 is operated is that required for priming.

It is generally accepted that the ink pressure at the channel orifices in the printhead should be maintained at a slightly reduced level, typically in the range of from −0.2 to −2.0 inches (−0.5 to −5.1 cms) of water. In the arrangement shown in the drawing, the location of the secondary tank 10 relative to the channel orifices determines the ink pressure at the latter and is adjusted to ensure that a negative pressure head is established and that the desired ink pressure at the channel orifices is achieved. The possibility of pressure surges occurring in the ink is reduced by the venting of the secondary tank 10 to atmosphere, at vent 15.

Figure 3:
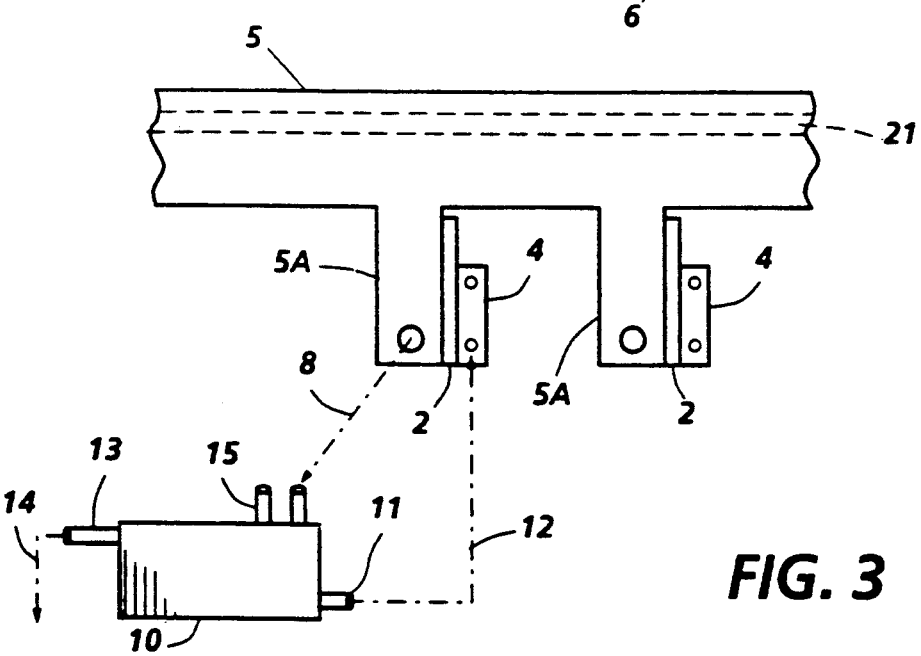
FIG. 3 is a diagram showing a plurality of printhead assemblies with a common heat sink.

In a colour printer (not shown), a plurality of printhead assemblies (typically, four) is provided, each assembly being as shown in FIG. 1 and being used to discharge ink of a particular colour. The heat sink 5 for a colour printer on which the printheads are mounted is common to all of the assemblies, as illustrated in FIG. 3, but each printhead is mounted on a separate cooling fin 5A of the heat sink and each printhead has its own main and secondary ink tanks 6, 10 and its own maintenance station 16. The plurality of printhead assemblies on the common heat sink 5 is mounted on a carriage (not shown) for reciprocal movement across the recording medium on which the ink from the printheads is to be deposited.

For satisfactory operation, it is desirable that the printheads 1 should all be maintained at a constant elevated temperature even under conditions of light use. To ensure this, a heater 21 is provided to heat the common heat sink 5 under the control of a temperature controller 22 (not shown in FIG. 3 but indicated in FIG. 2). Each printhead will, of course, also be heated during operation by its own channel resistors, with the degree of heating depending on the extent to which the printhead is used; i.e., a printhead that discharges a much-used colour of ink will receive more heat from its channel resistors than a printhead that discharges a little-used colour. The ink supply arrangement for each printhead, described above with reference to FIG. 1, reduces the risk of the printhead temperature rising above the desired level during periods of heavy use (due to channel resistor heating) because excess heat is carried away from the printhead by ink passing through the heat sink to the plurality of secondary tanks 10. Because each colour of ink circulates through the heat sink fin even when the respective printhead is not in use, each of the inks will contribute to the removal of heat from the more heavily-used (and hottest) printhead(s). The degree of cooling provided by the ink is directly proportional to the temperature difference between the printhead assembly through which the ink is flowing and the respective main tank 6, and directly proportional to the flow rate of the ink from the main tank. Thus the flow rate can be set, by design, to be high enough to accommodate the worst case conditions of ambient temperature and printing demands, or it can be controlled in dependence on operating conditions. Use of excess ink flow will cause the printhead heater 21 to provide more heat than otherwise needed.

The arrangement shown in the drawings enables effective control of the printhead temperature to be achieved in that it permits the use of a common printhead heater 21 and common temperature sensor 23 with an associated temperature controller 22 to ensure that the printheads 1 are maintained at an appropriate temperature even during periods of light use, without the risk that the printheads will become overheated during periods of heavy use. Based upon the temperature sensed by the temperature sensor, the temperature controller energizes the heater as required to maintain the desired temperature of the heat sink 5 which in turn controls the temperature of the printheads mounted thereon and having good thermal conducting interface therewith. In addition, the heat received by the ink during its passage through the heat sink 5 has the advantageous effect of conditioning the ink to the temperature of the printhead and also of de-aerating the ink in that it promotes the escape of excess dissolved gas from the ink before ink reaches the printheads. Any air that separates out of the ink and collects in the secondary tank 10 can be removed via the vent 15.

Figure 2:
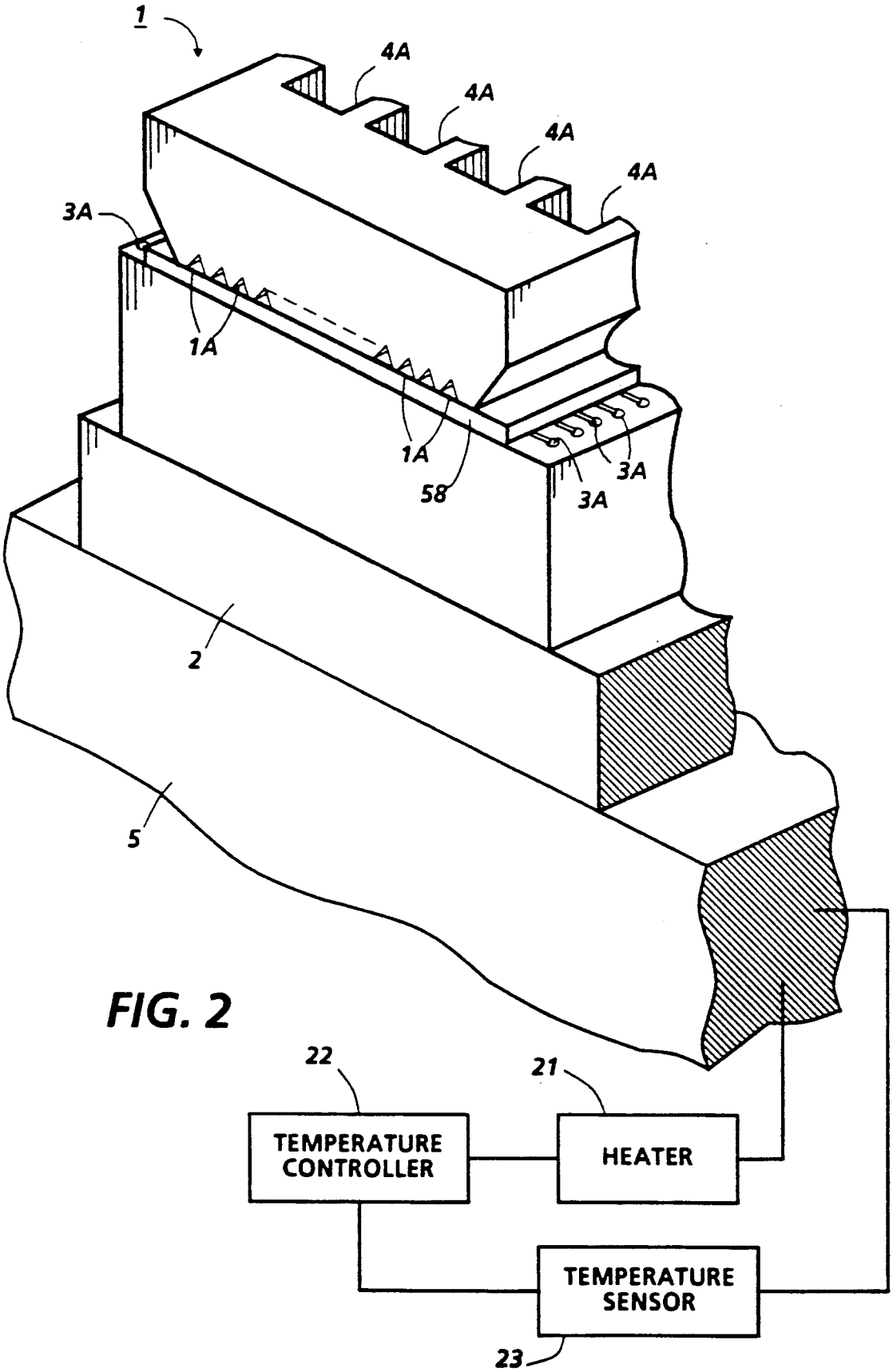
FIG. 2 is an enlarged, schematic, perspective view of part of the printhead assembly.

An arrangement as shown in the drawings can be used in a carriage-type of printer as described and is also applicable to large, stationary arrays of printheads with common heat sinks and large remote ink supplies such as are found in pagewidth printers. Certain other components of the system shown in FIG. 1 can also be shared by the (or some of the) printheads. For example, a single vacuum pump 18 only is required, even when (as, for example, in a color printer) there is more than one main tank 6. It will also be appreciated that the form of the printhead shown in FIG. 2 is not an essential feature and that other forms of printhead could be used.

We claim:

1. A printhead assembly for a thermal ink jet printer for depositing ink droplets on a recording medium, the assembly comprising:

a plurality of printheads each having at least one ink channel therein, an ink ejecting orifice at one end of the channel, and a heating element operable to apply heat to ink in said channel to cause ink droplets to be expelled from the ink ejecting orifice and propelled towards the recording medium;

a common heat sink in heat exchange relationship with said plurality of printheads;

means operable to supply heat to said common heat sink to thereby provide heat to said plurality of printheads; and a respective ink supply for supplying ink to each printhead, each ink supply being connected to an associated secondary tank through a separate supply path which passes through the heat sink, so that the ink passing through the heat sink is heatable thereby prior to entering said tank and the heat sink is in turn capable of being cooled by said passing ink, each printhead being connected to and supplied with heated ink from a respective one of the secondary tanks, which tanks are each vented to the atmosphere to enable any air which escapes from the heated ink to be vented therefrom.

2. An assembly as claimed in claim 1, in which the position of the tank relative to at least one of the printheads is adjustable to vary the ink pressure at the ink ejecting orifice(s).

3. An assembly as claimed in claim 1, wherein said ink supply is connected to supply ink to at least one of the ink supply paths, the tank in the said supply path having a return outlet connected by a return path to the ink supply.

4. An assembly as claimed in claim 3, including capping means movable into engagement with at least one of the printheads to cap the ink ejecting orifice(s) in the printhead, and means operable to apply suction to the printhead via the capping means to prime/clean the printhead and return any ink drawn from the printhead to the ink supply.

5. An assembly as claimed in claim 4, in which suction-applying means is connected to the capping means through the ink supply.

6. An assembly as claimed in claim 5, wherein the common heat sink has a plurality of separate cooling fins on which the printheads are mounted, one printhead for each fin; and wherein the supply path from the ink supply to the associated secondary tank is through a respective one of the fins.

7. An assembly as claimed in claim 3, wherein the means operable to supply heat to the common heat sink to heat the printheads comprises means for controlling the temperature of the common heat sink by sensing the temperature thereof and energizing a common heater thereon as required by the sensed temperature to keep the heat sink temperature within the desired temperature range, whereby the heat exchange relationship between the common heat sink and printheads enable the printheads to be maintained within a desired operating temperature.

8. A thermal ink jet printer for depositing ink droplets on a recording medium, the printer comprising:

a plurality of printheads, each having at least one ink channel therein, an ink ejecting orifice at one end of the channel, and a heating element operable to apply heat to ink in said channel to cause ink droplets to be expelled from the ink ejecting orifice and propelled towards the recording medium;

a common heat sink in heat exchange relationship with said plurality of printheads;

means operable to supply heat to said common heat sink to thereby provide heat to said plurality of printheads; and a respective ink reservoir for supplying ink to each printhead, each reservoir being connected to an associated secondary tank through a separate supply path which passes through the common heat sink, so that the ink passing through the heat sink is heatable thereby prior to entering said secondary tank and the heat sink is in turn capable of being cooled by said passing ink, each printhead begin connected to and supplied with heated ink from a respective one of the secondary tanks, which tanks are each vented to the atmosphere to enable any air which escapes from the heated ink to be vented therefrom.

9. A printer as claimed in claim 8, in which the heat sink and the plurality of printheads are mounted on a carriage for reciprocal movement across the recording medium.

10. A method of operating a thermal ink jet printer having a plurality of printheads, each of which eject and deposit ink droplets on a recording medium on demand from orifices therein, the operating method preventing the overheating of individual printheads during periods of heavy use comprising the steps of:

(a) mounting the plurality of printheads in predetermined separate locations on a common heat sink;

(b) pumping ink from a supply tank, one for each printhead, through a portion of the common heat sink adjacent a respective one of the printheads to a secondary tank, also one for each printhead, thereby heating the ink prior to entry into the secondary tank and preventing overheating of the printheads mounted on said common heat sink by the removal of heat therefrom by said ink passing therethrough;

(c) supplying heated ink to the printhead from the secondary tank;

(d) adjustably locating each secondary tank at a height relative to its associated printhead to maintain a predetermined negative pressure on the ink in said respective printhead, whereby ink to replace the ink ejected from the printhead is accomplished by capillary action from the secondary tank;

(e) controlling the temperature of the common heat sink by sensing the temperature thereof and energizing a heater thereon as required by the sensed temperature to keep the heat sink temperature within the desired temperature range during periods of light use or non-use; and (f) venting the secondary tank to the atmosphere to remove air released by the heated ink and to enable adjustment of the height of the ink in the secondary tank to adjust the pressure of the ink in the printheads.

11. The method of claim 10, wherein the method further comprises the steps of:

(g) providing a priming and capping station for each printhead during periods of non-use to maintain the printhead orifice in a controlled environment;

(h) connecting the capping stations to respective supply tanks via conduits or lines to enable a humid environment in each capping station and to provide means of returning ink from the priming and capping station to the supply tank; and (i) providing a vacuum source to the supply tank actuatable when desired to provide a suction on the orifices of the printhead through the priming and capping station to suck ink therefrom to prime said printheads and remove any air trapped therein.

12. The method of claim 11, wherein the method further comprises the steps of:

(j) connecting the secondary tank to the supply tank via a second conduit or line in which the interconnection of the second line with the secondary tank is in the upper portion thereof to establish the maximum height of ink therein; and (k) providing a valve in said second line which may be closed during priming, so that the pumping from the secondary tank to the supply tank may be stopped.

13. The method of claim 10, wherein the method further comprises the steps of:

(l) providing a separate cooling fin on the common heat sink for each printhead and mounting one printhead on each cooling fin; and (m) wherein the pumping of ink at step (b) is through the cooling fins, the ink from each supply tank being through a respective one of the cooling fins and then to a respective one of the secondary tanks.

* * * * *